US005685752A

United States Patent [19]

Fulton, Jr.

[11] Patent Number: 5,685,752

[45] Date of Patent: Nov. 11, 1997

[54] COMPRESSIBLE AND EXPANDABLE FLOATATION APPARATUS AND METHOD

[76] Inventor: Frank B. Fulton, Jr., 151 Northway, Severna Park, Md. 21146

[21] Appl. No.: 176,828

[22] Filed: Sep. 13, 1994

Related U.S. Application Data

[63] Continuation-in-part of Ser. No. 647, Jan. 5, 1994, abandoned.

[51] Int. Cl.[6] ..... B63C 9/125

[52] U.S. Cl. ..... 441/90; 441/88; 441/108

[58] Field of Search ..... 441/88, 90, 30, 441/108, 113; 222/514

[56] References Cited

U.S. PATENT DOCUMENTS

| | | | |
|---|---|---|---|
| 3,584 | 5/1844 | DeLiencourt | 441/90 |
| 205,617 | 7/1878 | d'Alessandro | 441/88 |
| 882,057 | 3/1908 | Forte | 441/90 |
| 1,315,190 | 9/1919 | Nekarda | 441/90 |
| 1,617,723 | 2/1927 | Roberts | 441/88 |
| 2,362,962 | 11/1944 | Bingham | 441/90 |
| 3,094,723 | 6/1963 | Manhart | 441/88 |
| 3,297,206 | 1/1967 | Scholle | 222/514 |
| 3,343,719 | 9/1967 | Kastamo et al. | 222/514 |
| 5,073,136 | 12/1991 | DeWitt et al. | 441/30 |

*Primary Examiner*—Thomas J. Brahan
*Attorney, Agent, or Firm*—Armstrong, Westerman, Hattori, McLeland & Naughton

[57] ABSTRACT

A method of and apparatus for floatation is provided in which a compressible and expandable float has a variable volume air chamber enclosed within a tubular main body portion made up of a foldable, cylindrical side wall and opposing end walls. One of the end walls of the floatation apparatus is non-apertured while the other end wall has an aperture therethrough which is openable and closable by means of a cap may be positioned on a spout surrounding the aperture in order to open and close the aperture against movement of air or water in or out of the air chamber. The cap allows for the opening and closing of the aperture in order to expand or compress the tubular body of the floatation apparatus by increasing or decreasing the amount of air in the air chamber. The cylindrical side wall of the floatation apparatus may be either bellows-shaped or formed from plastic sheet material enclosing an inner coiled wire in order to fold and unfold in an accordion-like manner to accommodate the compressing and expanding of the air chamber of the floatation apparatus. The aperture in one of the end walls of the floatation apparatus is capped to maintain the apparatus in an expanded or compressed state, but uncapped when the apparatus is being expanded from its compressed state or compressed from its expanded state. The apparatus also include a backdraft valve adjacent to the aperture inside the air chamber of the floatation apparatus. The backdraft valve allows air to exit the air chamber slowly, yet not affecting the speed of air entering the air chamber so as to be a safety feature to guard against rapid deflation of the floatation apparatus in the event the of an emergency situation when a user might be panicky.

6 Claims, 12 Drawing Sheets

COMPRESSIBLE AND EXPANDABLE FLOATATION APPARATUS AND METHOD

This is a continuation-in-part of application Ser. No. 08/000,647 filed on Jan. 5, 1994 now abandoned.

FIELD OF THE INVENTION

The present invention relates generally to floatation devices and, more particularly, to a method of and apparatus for floatation which includes a compressible and expandable float having a variable volume air chamber enclosed within a tubular main body portion made up of a foldable, cylindrical side wall and opposing non-apertured and cappable, apertured end walls such that when the apertured end wall is capped, the float may be maintained in a compressed state for storage or for compact carrying on a user's person or in an expanded state for use as a personal floatation device or marker and when the apertured end wall is uncapped, the float may be easily, yet slowly, compressed from its expanded state due to a backdraft valve which slows down air exiting the air chamber but does not affect the speed of air entering the air chamber or quickly self-expanded from its compressed state in emergency situations without the use of a pump, breathing tube or gas cartridge for inflation.

BACKGROUND OF THE INVENTION

Currently, floatation equipment exists, such as life saving jackets, vests or belts, which are usually worn on a user's person in order to keep the user afloat. Life jackets, vests or belts may be disadvantageous in certain circumstances because of being bulky, confining and/or cumbersome so as to get in the way of the user's activities. Additionally, life jackets, vest and belts may have the disadvantage of being prohibitively expensive.

Other types of floatation or buoying devices exist, such as water wings, life rings, inner tubes, kickboards, rafts, etc., which may be either worn or held by the user in order to keep the user afloat. Often these types of floatation devices are not well adapted for use in emergency situations because of the fact that the floatation devices are either bulky so that they cannot easily be carried on the user's person or they require inflation by the use of a pump, breathing tube or a gas cartridge.

The use of a pump for inflation of a floatation device has disadvantages. For instance, inflating a floatation device by means of a pump is often time-consuming. Furthermore, inflation of a floatation device may be inconvenient since a pump must be located and attached to the floatation device prior to inflation and pumps are not always readily available.

The use of a breathing tube for inflation of a floatation device has disadvantages. This is because inflating a floatation device by means of a user blowing air through a tube is extremely time consuming so as to be impractical for use in an emergency situation. This is especially true in emergency situations where the use of the floatation apparatus is panicky and may be gasping for air.

The use of gas cartridges for inflation of a floatation device is disadvantageous for several reasons. First, gas cartridges are relatively expensive. Second, gas cartridges may not always dependable in emergency situations since the gas cartridges tend to corrode unless extensive maintenance is performed to prevent a shortening of the useful life of the gas cartridge.

Thus, a need exists for a compressible and self-expandable floatation apparatus which is compressible into as compact a unit as possible in order to be worn on a user's person without getting in the way of the user's activities, yet is quickly and easily self-expandable for use as a personal floatation device or marker without the use of a pump, breathing tube or gas cartridge for inflation.

The present invention provides a method of and an apparatus for floatation wherein a float having a tubular body portion made up of an inner air chamber which is enclosed by end walls and a foldable cylindrical side wall to be easily compressible and quickly self-expandable. Indeed, the floatation apparatus is compressible into a compact unit for storage or for carrying on a user's person without getting in the way of the user's activities, while at the same time the floatation apparatus is quickly self-expandable in emergency situations without the use of a pump, breathing tube or gas cartridge for inflation.

The compressible and expandable floatation apparatus and method of the present invention is adaptable for use in a variety of situations. For instance, swimmers may wear the floatation apparatus in the surf for use in the event they get caught in a rip current or undertow. Snorkelers may wear the floatation apparatus to provide buoyancy or in order to take a rest from swimming. Sailboaters and power boaters may wear the floatation apparatus as a protection in the event they fall overboard. Fire and rescue personnel may use the floatation apparatus to keep themselves or victims afloat. Children may use the floatation apparatus as a precaution when they are near the shore or as a float when they are in pools, lakes, rivers, oceans, or other bodies of water.

The present invention may also have industrial uses as a personal floatation device in commercial aviation or as a marker for swimming, snorkeling, rescue operations, fishing, or crabbing. The airline industry could use the floatation apparatus on flights for easy, compact storage of the float in its compressed state in the limited spaces of an aircraft and for quick expansion by passengers after exiting the small openings of an aircraft in the event of an emergency such as a water landing. The floatation apparatus may be adapted for use to mark swimming or snorkeling areas, to mark areas searched or dragged by rescue personnel, or to mark fishing nets or crab traps. Indeed, the present invention is ideal for fishing and/or crabbing applications because since its compressibility for storage saves precious space on small fishing boats.

SUMMARY OF THE INVENTION

The present invention provides a method of and apparatus for floatation through the use of a float having a tubular main body portion which includes an inner air chamber enclosed by end walls and a foldable cylindrical side wall which is easily compressible for compact carrying on a user's person when not in use, yet quickly self-expandable in emergency situations without the use of a pump, breathing tube or gas cartridge for inflation. The floatation apparatus is easily compressible and self-expandable by means of an aperture through one of the end walls, which aperture is surrounded by a spout in order to receive a cap for opening and closing of the aperture to expand or compress the inner chamber by increasing or decreasing the amount of air in the chamber in response to the accordion-like folding or unfolding of the cylindrical side wall.

The cap on the spout surrounding the aperture of the floatation apparatus is closed in order to maintain the apparatus in an expanded or compressed state but opened when the apparatus is being expanded from its compressed state or compressed from its expanded state. The cylindrical side wall is capable of unfolding in response to the uncapping of the aperture by either manual manipulation or by automatic self-expansion in response to a spring load.

The spring load on the cylindrical side wall may be achieved either by means of molding of a self expansible material such as a closed-cell foam material in to a bellows-shape or by use of a coiled wire within the laminated layers of the cylindrical side wall material. Alternatively, a plastic-coated coiled wire or spring may be placed within the inner chamber of the floatation apparatus to assist the molded, bellows-shaped self expansive material in automatically unfolding the cylindrical side walls.

BRIEF DESCRIPTION OF THE DRAWING

FIG. 2(*b*) is a cross-sectional view through the cap and backdraft valve of the preferred embodiment of the compressible and expandable floatation apparatus shown with the cap in its opened position.

FIG. 18(*b*) is a top view of the push-pull type cap used in the fifth embodiment of the invention.

FIG. 18(*c*) is a partial cut-away showing the inside cross-section of the push-pull type cap used in the fifth embodiment of the invention.

FIG. 19(*b*) is a cross-sectional view of the twist cap shown in FIG. 18(*a*).

FIG. 20(*b*) is a front view of a closed flip-top cap which forms a second alternate embodiment of the cap shown in FIGS. 2(*a*) and 2(*b*).

FIG. 21(*b*) is an end view of the second embodiment of the touch-button type cap as is shown in FIGS. 2(*a*) and 2(*b*).

DETAILED DESCRIPTION OF THE INVENTION

Figure 1:
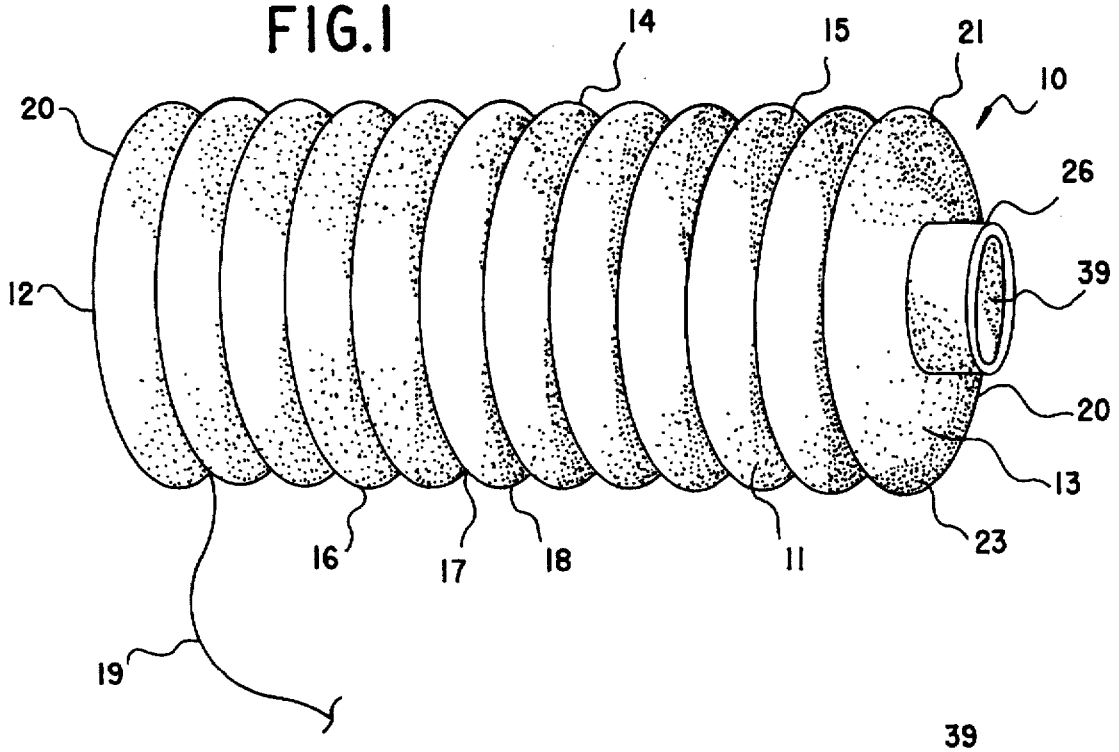
FIG. 1 is a front view of the preferred embodiment of a compressible and expandable floatation apparatus shown in its fully expanded state.

The drawing figures depict several embodiments of the compressible and expandable floatation apparatus of the present invention. Referring to FIG. 1, the preferred embodiment of the floatation apparatus 10 is shown in its fully expanded state. The floatation apparatus 10 (210, 310, 410 and 510) forms a tubular main body portion 11 (211, 311, 411, and 511) having s non-apertured end wall member 12 (212, 312, 412 and 512), an apertured end wall member 13 (213, 313, 413 and 513) and a cylindrical side wall 14 (214, 314, 414 and 514) extending between the end wall members 12 (212, 312, 412 and 512), 13 (213, 313, 413 and 513) to enclose a compressible and expandable air chamber 15 (215, 315, 415 and 515).

In the preferred embodiment of the present invention (as well as the third and fifth embodiments to be discussed in more detail below), the cylindrical side wall 14 (314 and 514) has a generally bellows-shape in order to fold in an accordion-like manner. The bellows-shape of the cylindrical side wall 14 (314 and 514) is formed by integrally connecting of a plurality of substantially circular bellows 16 (316 and 516). Each bellow 16 (316 and 516) may be made of an alternating short and long conical section 17 (317 and 517), 18 (318 and 518) as taught in U.S. Pat. Nos. 4,773,458 and 4,492,313, which teachings are hereby incorporated by reference, or each bellow 16 (316 and 516) may be made up of equal length conical sections as is taught in U.S. Pat. No. 3,465,921, which teachings are hereby incorporated by reference. The short and long conical sections 17 (317 and 517), 18 (318 and 518) or the equal length conical sections are integrally connected to each other, preferably by molding, at a predetermined angle.

In the preferred embodiment of the present invention (as well as the second, third and fifth embodiments to be discussed in more detail below), the cylindrical side wall 14 (214, 314 and 514) is approximately four to four and one-half inches in diameter at its outside dimension in order to provide the air chamber 15 (215, 315 and 515) of the floatation apparatus 10 (210, 310 and 510) with the minimum capacity of approximately one gallon needed to keep an average user afloat, while at the same time allowing for compression of the floatation apparatus 10 (210, 310 and 510) into as compact a unit as possible for comfortable carrying on the user's person when the floatation apparatus 10 (210, 310, 410 and 510) is in its compressed state.

As air is drawn into the air chamber 15 (215, 315, 415 and 515), the cylindrical side wall 14 (214, 314, 414 and 514) will begin to unfold automatically for use as a floatation apparatus 10 (210, 310, 410 and 510). The folding of the cylindrical side wall 14 (214, 314, 414 and 514) allows the floatation apparatus 10 (210, 310, 410 and 510) to compress for either storage or compact carrying on a user's person when not in use.

As the floatation apparatus 10 (210, 310, 410 and 510) is compressed and expanded, the air chamber 15 (215, 315, 415 and 515) varies in volume according to the length of the cylindrical side wall 14 (214, 314, 414 and 514). The length of the cylindrical side wall 14 (214, 314, 414 and 514) varies according to its degree of folding which, in turn, depends on the amount of compression or expansion applied to the floatation apparatus 10 (210, 310, 410 and 510).

When in its fully expanded state, the third embodiment of the floatation apparatus 310 as shown in FIGS. 4–11 measures approximately twenty inches end to end, the cylindrical side wall is unfolded to its longest length, and the air chamber 315 reaches its maximum capacity of approximately one gallon. When in its fully compressed state, the third embodiment of the floatation apparatus 310 as shown in FIGS. 4–11 measures approximately five to six inches end to end, the cylindrical side wall 314 is folded to its shortest length and the air chamber 315 reaches its minimum volume.

Figure 15:
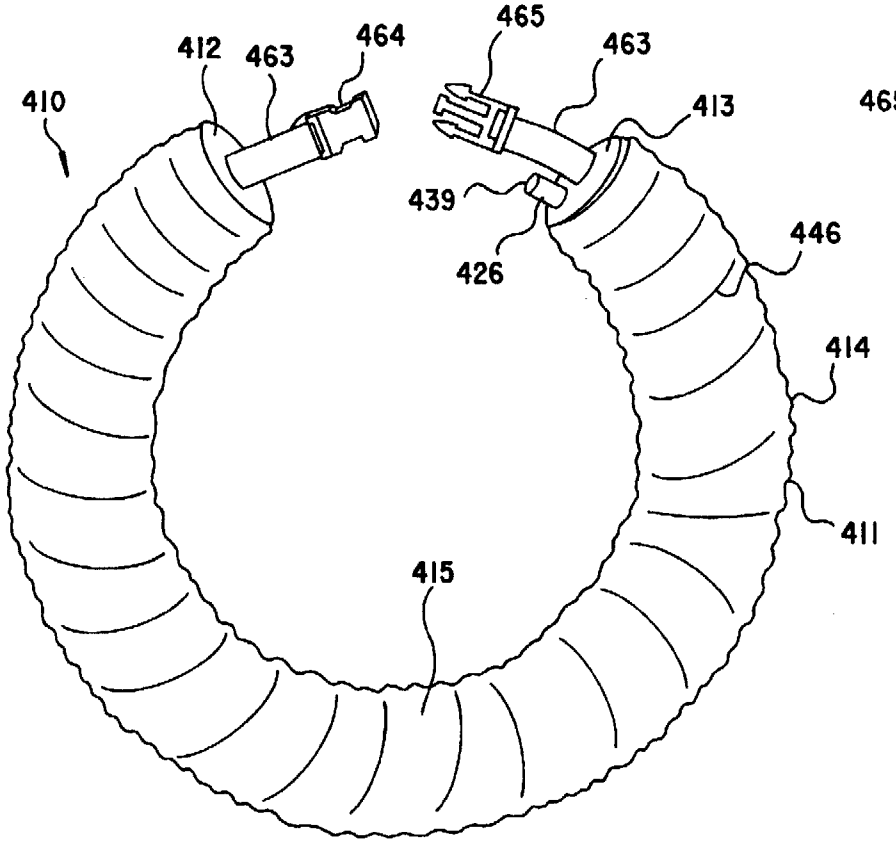
FIG. 15 is a top plan view of a fourth embodiment of the compressible and expandable floatation apparatus.

The fourth embodiment of the floatation apparatus 410 as shown in FIG. 15, has a cylindrical side wall that is approximately 3 inches in diameter, the floatation apparatus 410 is approximately 5 to 6 feet long when its fully expanded state and the floatation apparatus 410 has an approximately one and one-half gallon capacity.

In the preferred embodiment of the present invention, the cylindrical side wall 14 of the floatation apparatus 10 is made from a non-porous, self-expansible, elastomeric material so as to both keep water from getting into and air from leaking out of the air chamber 15 of the floatation apparatus 10 through the cylindrical side wall 14, to provide springiness for the self-expansibility of the cylindrical side wall 14, and to provide its own buoyancy for the floatation apparatus 10. Materials for use in manufacturing the cylindrical side wall 14 are self expansible materials such as a closed-cell foam which lend their own buoyancy to the buoyancy of the floatation apparatus 10, preferably polyethylene foam tape or a neoprene sponge tape.

Polyethylene foam tape is a medium density closed-cell foam tape which may be purchased from many distributors under numerous product names, however, in the preferred embodiment, a material sold under the product name E Series-Polyethylene Foam Tape by Lamatek Inc. of Cinnaminson, N.J. is used. Polyethylene foam tape may be purchased in colors of white, black or special colors such as bright yellow or orange and is available in thicknesses from 1/32nd of an inch to one inch and widths from 1/16th of an inch to 54 inches. In the preferred embodiment of the present invention, half-inch thick polyethylene in bright yellow and orange is used for resiliency and visibility.

Neoprene is the general purpose synthetic rubber used in wet suits and has the characteristics of being a long life closed-cell watertight sponge with a good resilience and recovery. Neoprene is manufactured by E. I. Du Pont de Nemours & Company of Wilmington, Del. and may be purchased from any one of many distributors, including, Lamatek Inc. of Cinnaminson, N.J. under the product name N Series-Neoprene Sponge Tape. Neoprene may be purchased in colors of black or gray, in grades of soft, medium or firm, in thicknesses of 1/16th of an inch to one inch, and in widths of 1/16th of an inch to 54 inches.

In the preferred embodiment, the combination of the elasticity of the closed-cell foam material used for the side wall 14 and the molding or extruding of the foam into the bellows-shape of the cylindrical side wall 14 allows the floatation apparatus 10 to be self-expansible without the need of a coiled wire, either embedded in the laminate layers of the cylindrical side wall 14 or positioned within the air chamber 15, to provide the spring loaded action for the cylindrical side wall 14 to be automatically self expansible.

Both the non-apertured end wall member 12 (212, 312, 412 and 512) and the apertured end wall member 13 (213, 313, 413 and 513) may be molded from plastic, preferably polyethylene, although any appropriate material and method of formation may be used without departing from the spirit and scope of the present invention. Further, with respect to the preferred embodiment of the present invention (and the second embodiment to be described in detail below), the non-apertured end wall member 12 (212) is specially molded so that a string tether 19 (219) trails from the non-apertured end wall member 12 (212) in order to tether the floatation apparatus 10 (210) from floating away.

Both molded end wall members 12 (212, 312, 412 and 512), 13 (213, 313, 413 and 513) include a circular disk-shaped end wall plate 20 (220, 320, 420 and 520) having inner and outer end wall surfaces 21 (221, 321, 421 and 521), 22 (222, 322, 422 and 522), shoulders 23 (223, 323, 423 and 523), and a end wall extension 24 (224, 324, 424 and 524). The apertured end wall member 13 (213, 313, 413 and 513) is further molded to have a circular aperture 25 (225, 325, 425 and 525) through the end wall plate 20 (220, 320, 420 and 520) and a cylindrical spout 26 (226, 326, 426 and 526) surrounding the aperture 25 (225, 325, 425 and 525) and protruding perpendicularly outwardly from the outer surface 22 (222, 322, 422 and 522) of the end wall plate 20 (220, 320, 420 and 520).

The outer surfaces 22 (222, 322, 422 and 522) of the end wall plates 20 (220, 320, 420 and 520) of the non-apertured and apertured end wall members 12 (212, 312, 412, and 512), 13 (213, 313, 413 or 513) may be either flat or slightly concave. The inner surfaces 21 (221, 321, 421 and 521) of the end wall plates 20 (220, 320, 420 and 520) of the non-apertured and apertured end wall members 12 (212, 312, 412, or 512), 13 (213, 313, 413 or 513) may be either correspondingly flat or slightly convex, respectively. The shoulders 23 (223, 323, 423 and 523) are either squared or rounded to connect the peripheral edge of the end wall plates 20 (220, 320, 420 and 520) to the end wall extensions 24 (224, 324, 424 and 524). The end wall extensions 24 (224, 324, 424 and 524) protrude perpendicularly outwardly from the inner surfaces 21 (221, 321, 421 and 521) of the end wall plates 20 (220, 320, 420 and 520) for connection of the end wall members 12 (212, 312, 412 and 512), 13 (213, 313, 413 and 513) to the cylindrical side wall 14 (214, 314, 414 and 514).

The end wall members 12 (212, 312, 412 and 512), 13 (213, 313, 413 and 513) of the floatation apparatus 10 (210, 310, 410 and 510) are attached to the cylindrical side wall 14 (214, 314, 414 and 514) by means of an airtight permanent bond in order that the air chamber 15 (215, 315, 415 and 515) be airtight. Although the airtight permanent bond connecting the end walls 12 (212, 312, 412 and 512), 13 (213, 313, 413 and 513) to the cylindrical side wall 14 (214, 314, 414 and 514) is preferably formed by heat-sealing, any method capable of forming an airtight connection between the end wall members 12 (212, 312, 412 and 512), 13 (213, 313, 413 and 513) and the cylindrical side wall 14 (214, 314, 414 and 514) may be used without departing from the spirit and scope of the present invention.

Indeed, in the preferred embodiment of the present invention (as well as the third and fifth embodiments to be discussed in more detail below), the molded end wall members 12 (312 and 512), 13 (313 and 513) may even be molded from the same material that the cylindrical side wall 14 (314 and 514) is made of and molded at the same time that the bellows-shaped cylindrical side wall 14 (314 and 514) is molded in order to form an even more airtight connection between the end wall members 12 (312 and 512), 13 (313 and 513) and the cylindrical side wall 14 (314 and 514) and thus, minimize the amount of air leakage from the connection of the end wall members 12 (312 and 512), 13 (313 and 513) to the cylindrical side wall 14 (314 and 514).

Figure 2A:
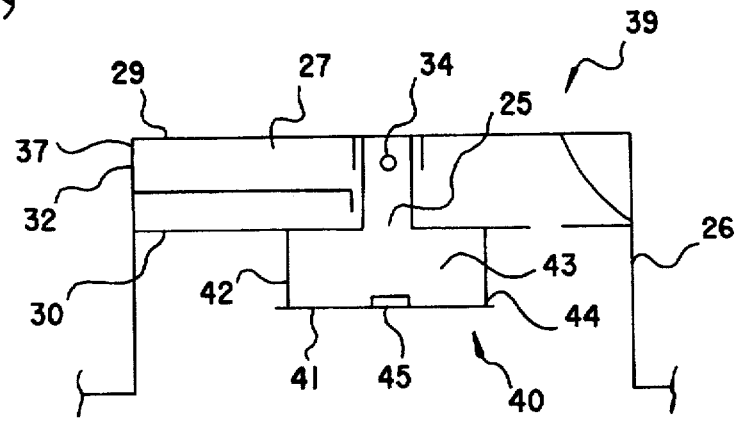
FIG. 2(*a*) is a cross-sectional view through the cap and backdraft valve of the preferred embodiment of the compressible and expandable floatation apparatus shown with the cap in its closed position.
Figure 2B:
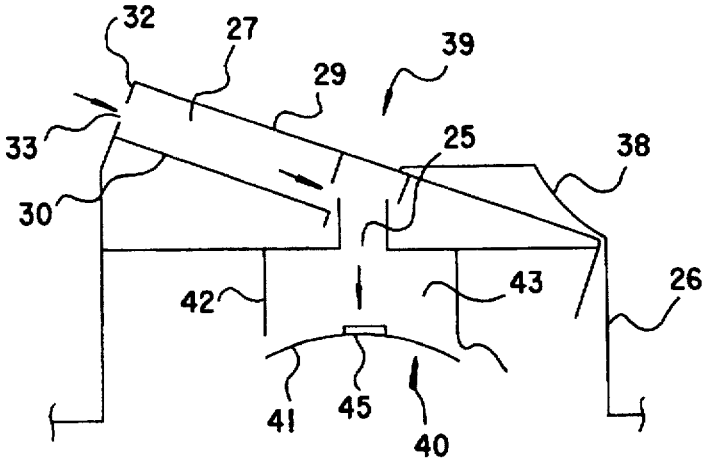
Figure 3:
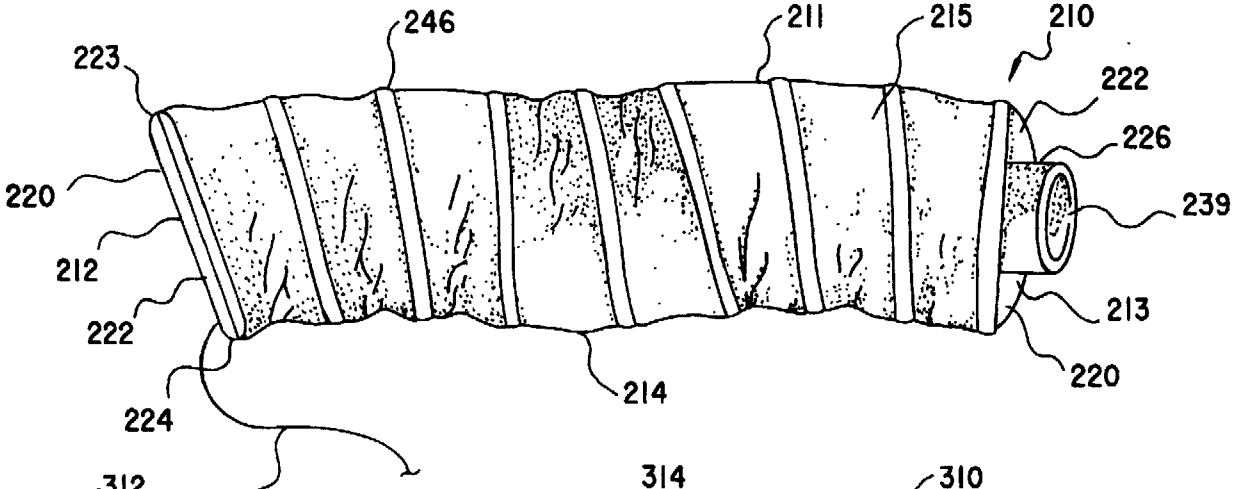
FIG. 3 is a front view of a second embodiment of the compressible and expandable floatation apparatus shown in its fully expanded state.

Referring to FIGS. 2 and 3, a rocker member 27 (227 and 427) is shown in cross-section in a flush and tilted position, respectively. The rocker member 27 (227 and 427) includes a circular disk-shaped end wall 28 (228 and 428) with a flat outer surface 29 (229 and 429) and a flat inner surface 30 (230 and 430). The flat outer surface 29 (229 and 429) has an indentation 31 (231 and 431) for a user to press upon to move the rocker member 27 (227 and 427) from its flush to its tilted position. The rocker member 27 (227 and 427) also includes a cylindrical peripheral side wall 32 (232 and 432) which extends transversely outwardly from the flat inner surface 30 (230 and 430) of the rocker member 27 (227 and 427). The cylindrical peripheral side wall 32 (232 and 432) of the rocker member 27 (227 and 427) includes a slotted hole 33 (233 and 433).

The rocker member 27 (227 and 427) fits within the spout 26 (226 and 426) surrounding the aperture 25 (225 and 425) of the apertured end wall member 13 (213 and 413) via a hinge-like arrangement 34 (234 and 434). The hinge-like arrangement 34 (234 and 434) includes protrusions 35 (235 and 435) on the outer periphery of the cylindrical peripheral side wall 32 (232 and 432) which mate with indentations 36 (236 and 436) on the inner side wall of the spout 26 (226 and 426). The hinge-like arrangement 34 (234 and 434) allows the rocker member 27 (227 and 427) to be positioned either flush or tilted at an angle of approximately 30° to 45° with the outer peripheral rim 37 (237 and 437) of the spout 26 (226 and 426). The spout 26 (226 and 426) may have an arch-shaped indentation 38 (238 and 438) for some length of its periphery in order to accommodate the tilting of the rocker member 27 (227 and 427).

When the rocker member 27 (227 and 427) is flush with the rim 37 (237 and 437), the spout 26 (226 and 426) and rocker member 27 (227 and 427) form a closed cap 39 (239 and 439) over the aperture 25 (225 and 425) in the end wall plate 20 (220 and 420). This is because when the rocker member 27 (227 and 427) in flush with the rim 37 (237 and 437) of the spout 26 (226 and 426) the slotted hole 33 (233 and 433) through the cylindrical peripheral side wall 32 (232 and 432) of the rocker member 27 (227 and 427). On the other hand, when the rocker member 27 (227 and 427) is tiled at an angle to the rim 37 (237 and 437), the spout 26 (226 and 426) and rocker member 27 (227 and 427) form a open cap 39 (239 and 439) over the aperture 25 (225 and 425) in the end wall plate 20 (220 and 420) because the slotted hole 33 (233 and 433) on the cylindrical peripheral side wall 32 (232 and 432) is not blocked by being against any surface and is free to allow air to flow through it and through the aperture 25 (225 and 425) to a backdraft valve 40 (240, 340 and 440) in the air chamber 15 (215, 315 and 415).

The backdraft valve 40 (240, 340 and 440) includes a flap 41 (241, 341 and 441) and a cylindrical backdraft chamber wall 42 (242, 342 and 442) which extends perpendicularly outwardly from the inner surface 21 (221, 321 and 421) of the end wall plate 20 (220, 320 and 420) of the apertured end wall member 13 (213, 313 and 413) to form a cylindrical backdraft chamber 43 (243, 343 and 443). The flap 41 (241, 341 and 441) is made from a sheet of thin plastic, preferably polyethylene or rubber, which is cut into a circular shape of a diameter slightly larger than the outer diameter of the cylindrical backdraft chamber wall 42 (242, 342 and 442).

The flap 41 (241, 341 and 441) is positioned at the open end of the cylindrical backdraft chamber wall 42 (242, 342 and 442) to cover a cylindrical backdraft chamber 43 (243, 343 and 443). The flap 41 (241, 341 and 441) contacts the peripheral rim 44 (244, 344 and 444) of the cylindrical backdraft chamber wall 42 (242, 342 and 442) and is attached to the rim 44 (244, 344 and 444) in only two positions 45 (245, 345 and 445) around the outer periphery of the rim 44 (244, 344 and 444). The outer periphery of the flap 41 (241, 341 and 441) slightly overlaps the outer periphery of the cylindrical backdraft chamber 43 (243, 343 and 443) as is shown in FIGS. 2(*a*) and 2(*b*).

With the flap 41 (241, 341 and 441) in place, air is funnelled from the slotted opening 33 (233, 333 and 433) through the backdraft valve 42 (242, 342 and 442) and aperture 25 (225, 325 and 425) of the apertured end wall member 13 (213, 313 and 413) into the air chamber 20 (220, 320 and 420). In this way, the flap 70 (270, 370 and 470) acts to slow down the amount of air exiting the air chamber 15 (215, 315 and 415) by temporarily blocking the air and allowing the air to exit only slowly from the aperture 25 (225, 325 and 425) via the backdraft valve 40 (240, 349 and 440).

At the same time, the backdraft valve 40 (240, 340 and 440) does not interfere with the speed of air entering the air chamber 15 (215, 315 and 415) when the floatation apparatus 10 (210, 310 and 410) is being expanded. This is because the flap 41 (241, 341 and 441) does not seal the cylindrical backdraft chamber 43 (243, 343 and 443) when air is entering the aperture 25 (225, 325 and 425) in the direction of the arrows shown in FIG. 2. The air pushes against the flap 41 (241, 341 and 441) to deflect the majority of the outer periphery of the flap 41 (241, 341 and 441) downward except at the two positions 45 (245, 345 and 445) where the flap 41 (241, 341 and 441) is attached to the cylindrical backdraft chamber 43 (243, 343 and 443).

A model of the floatation apparatus 10 of the preferred embodiment was constructed out of a bright orange, ½ inch polyethylene foam tape material. When the polyethylene model was tested, the floatation apparatus 10 met the Coast Guard's standards for Type V (Hybrid) personal floatation devices. The Coast Guard standards for Type V (Hybrid) personal floatation devices require a minimum of 22.0 pounds of buoyancy for an adult when fully inflated and 7.5 pounds of buoyancy for an adult when deflated.

A second model of the floatation apparatus 10 was built out of a black, ¼ inch thick neoprene sponge tape material. The neoprene model was built in a slightly modified manner that the polyethylene model. The neoprene model was first modified by replacing the non-apertured end wall member with a ½ inch thick, 4 inch diameter layer of neoprene in order for the end wall member to become an integrally molded part of the floatation apparatus 10. This design allows for better sealing and less leakage of air.

The neoprene model may also be modified from the polyethylene version by placement of a spring inside the air chamber 15 so as to assist in the speed of the self-expansion of the cylindrical side wall 14 upon opening of the cap 39. The spring used would be metal so as to require coating by a water resistant material to protect against corrosion.

Finally, the neoprene model may further be modified from the polyethylene version by inclusion of a bright, tough, lining material on the outer surface of the neoprene cylindrical side wall 14 in order to protect the neoprene from abrasion and to add visibility to the neoprene model. The preferred material for the liner would be a urethane coated fabric of single coated packcloth. This material may be purchased from any one of a number of distributors including under style no. 1392 from Uretek, Inc. of 30 Lenox Street, New Haven, Conn. 06513. The material is available in different color fabrics and coatings and is heat sealable, abrasion and puncture resistant, high strength and suitable for marine use in inflatables as being a Coast Guard approve hybrid fabric.

Referring to FIG. 3, the second embodiment of the expandable and compressible floatation apparatus 210 is shown. The floatation apparatus 210 of the second embodiment of the present invention is similar to the floatation apparatus 10 of the preferred embodiment except that the cylindrical side wall 214 is made of a material that is not moldable into a bellows shape such that the cylindrical side wall folds 214 by means of a coiled wire 246 embedded within the laminated layers of the material of the cylindrical side wall 214.

In the second embodiment of the present invention, the cylindrical side wall 214 of the floatation apparatus 210 is made from a non-porous material such as plastic which is preferably a non-porous material sold under the product name MAX-FLYTE 1PV-EP by Dura-Vent, Inc. of Plymouth, Ind. This material is a one-ply polyester-vinyl laminate which encloses a helically shaped, expanded-pitch steel wire 246 between its laminate layers.

This material is advantageous for several reasons. The material is manufactured with a four-inch outside diameter in a bright yellow or orange color to be easily visible in or near the water. The material is lightweight and highly compressible, which high degree of compression allows for rapid air movement during expansion of the floatation apparatus and for the automatic self-expandibility of the cylindrical side wall 214 due to the spring action of the coiled wire 246 within the laminate layers. Finally, the material is tough and puncture-resistant, resistant to salt water and chlorine and has a temperature range of −20° F. to 180° F.

Figure 4:
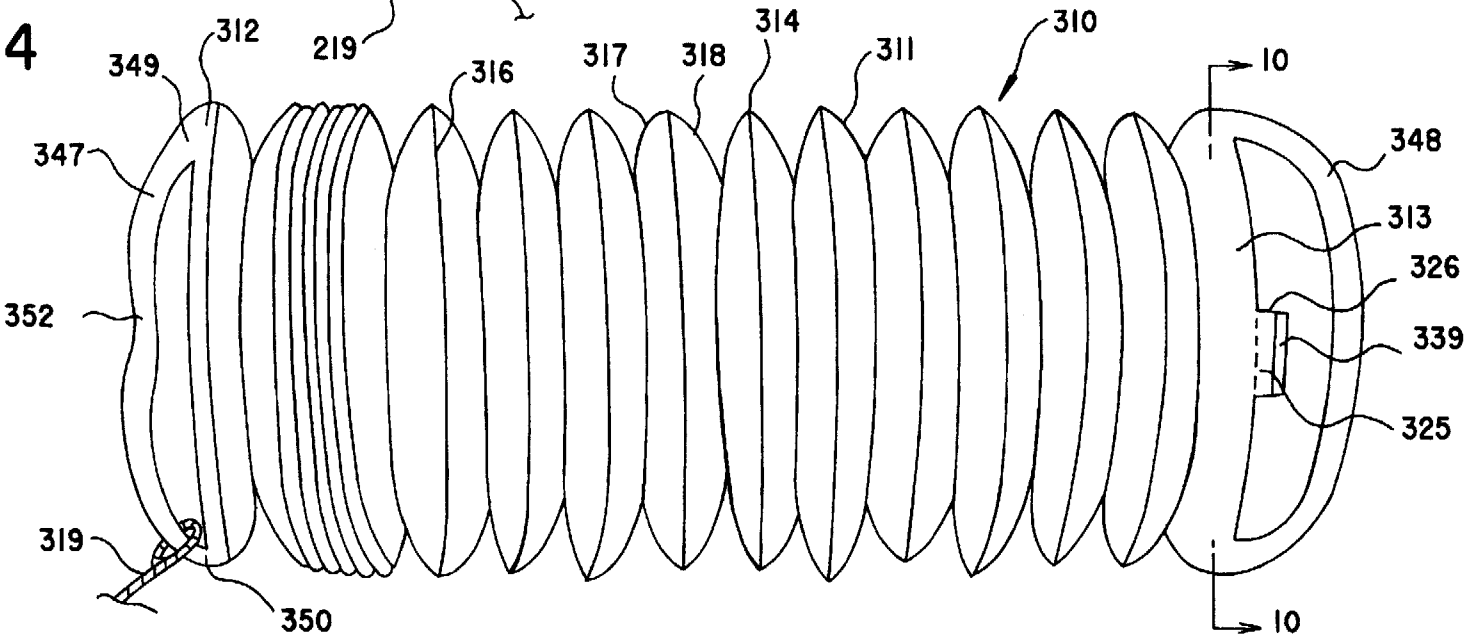
FIG. 4 is s front view of a third embodiment of a compressible and expandable floatation apparatus shown in a partially expanded state.
Figure 5:
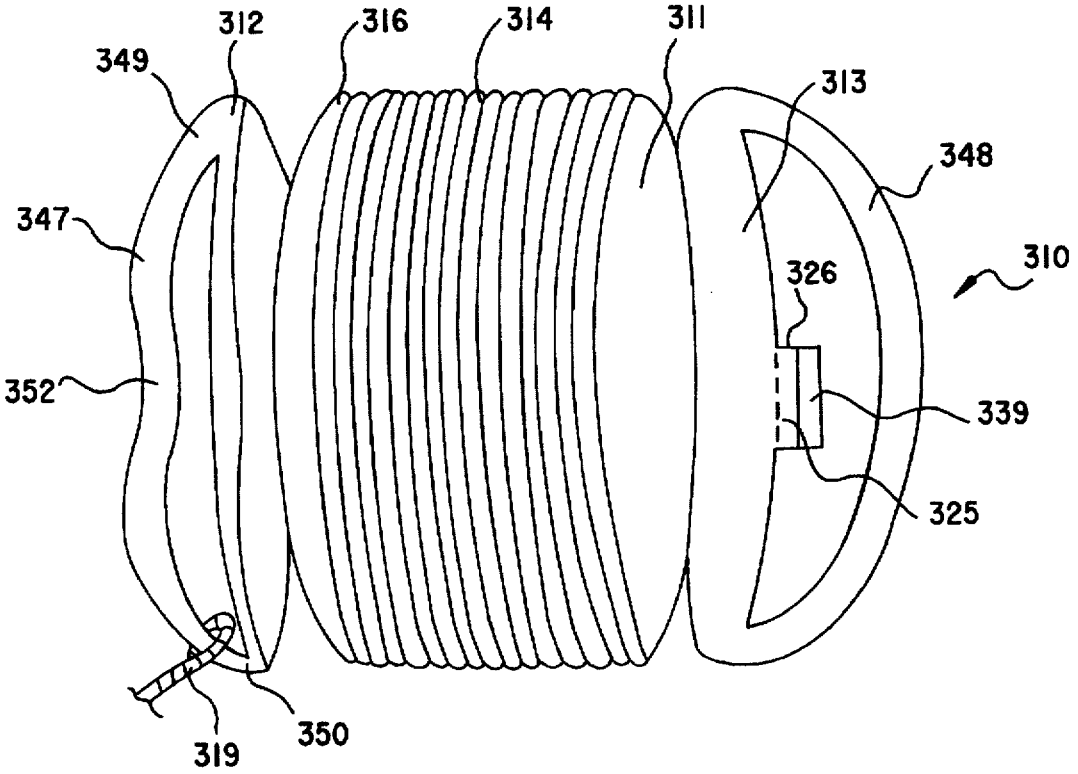
FIG. 5 is a front view of the third embodiment of the compressible and expandable floatation apparatus shown in its compressed state.

Referring to FIGS. 4–12, a third embodiment of the compressible and expandable floatation apparatus 310 is shown. FIG. 4 shows the floatation apparatus 310 in its partially expanded state and in FIG. 5 shows the floatation apparatus 310 its fully compressed state. The floatation apparatus 310 includes a tubular body portion 311 having a non-apertured end wall 312, an apertured end wall 313 and a cylindrical side wall 314 which extends between the end walls 312, 313 to enclose an expandable and compressible air chamber 315.

FIGS. 4 and 5 particularly illustrate that the third embodiment of the floatation apparatus 310 includes a cylindrical side wall 314 that is generally bellows-shape similar to the side wall 14 of the preferred embodiment and formed in the same manner.

End walls members 312, 313 are both circular disk shaped and have either a flat or concave outer surface from which handles 347, 348 extend, respectively. The handles 347, 348 extend transversely outwardly from the outer surfaces 322 of the end wall members 312, 313 so as to be grippable by the hands of a user of the floatation apparatus 310 in order to fold or unfold the cylindrical side wall 314 and thus, compress or expand the air chamber 315 of the floatation apparatus 310.

The handles 347, 348 extend transversely outwardly from the outer surface of the end wall members 312, 313 so as to be grippable by the hands of a user of the floatation apparatus 310 to fold or unfold the cylindrical side wall 314 and compress or expand the air chamber 315 of the floatation apparatus 310.

Figure 6:
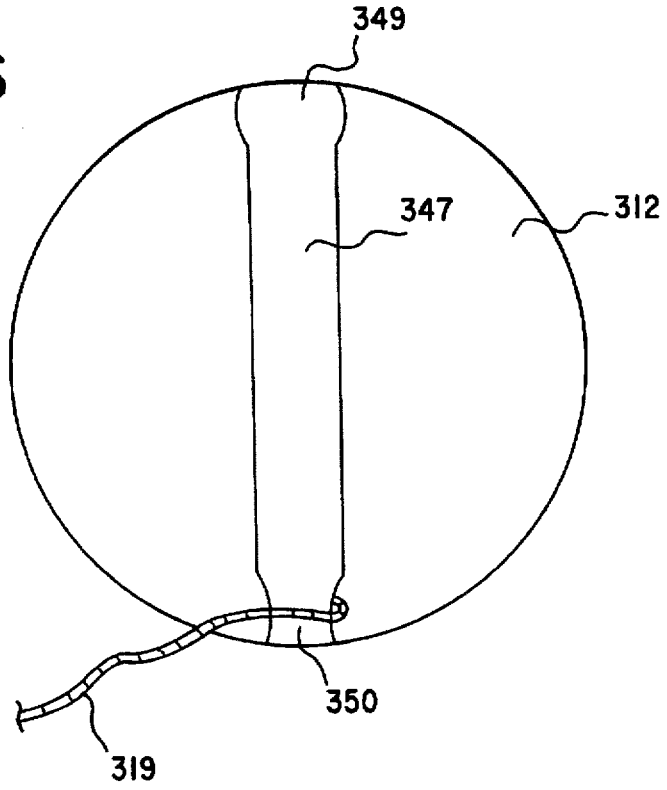
FIG. 6 is an end view of the third embodiment of the compressible and expandable floatation apparatus showing the handle on the non-apertured end wall.
Figure 7:
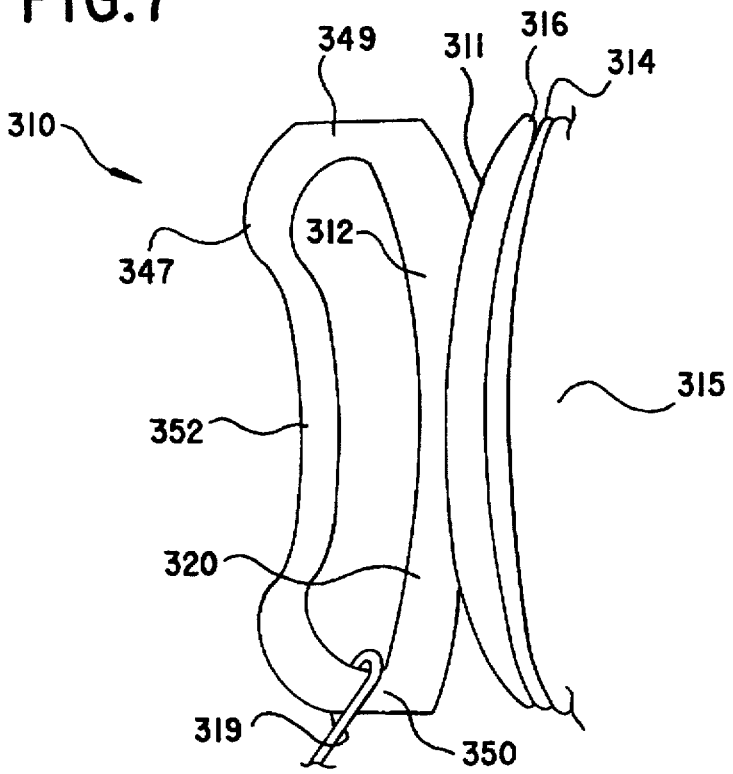
FIG. 7 is a partial front view of the third embodiment of the compressible and expandable floatation apparatus showing details of the handle on the non-apertured end wall.

Preferably, the handle 347 on the non-apertured end wall member 312 differs from the handle 348 on the apertured end wall member 313. Referring to FIGS. 4, 5 and 7, the handle 348 on the non-apertured end wall 313 is U-shaped with bulbous ends 349 on each end of the handle 348 where the handle 348 meets and is integrally connected to the outer surface 322 of the end wall member 313. The handle 347 on the non-apertured end wall member 312 is not bulbous at both ends of the handle 347, but narrows at one end as is shown in FIG. 6. This narrowed area 350 at one end of the handle 347 allows for attachment of a string tether 319 to the handle 347.

Figure 12:
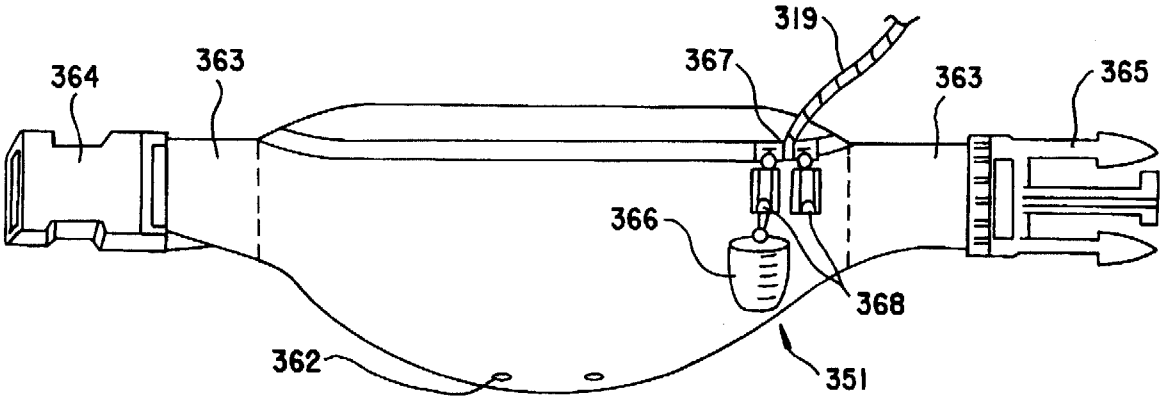
FIG. 12 is a front view of a pouch to which the compressible and expandable floatation apparatus may be tethered for carrying the floatation apparatus in its compressed state.
Figure 13:
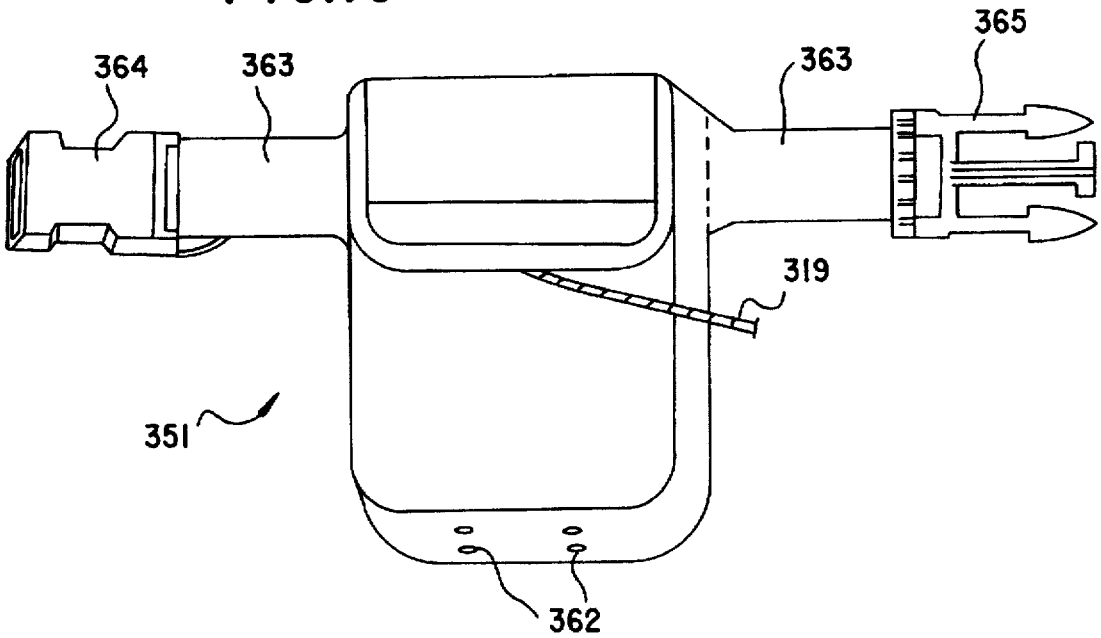
FIG. 13 is a front view of a second embodiment of pouch shown in FIG. 12.

The string tether 319 is attached tightly enough to the narrowed area 350 of the handle 347 so that there is no slack in the attachment to ensure that the string tether 319 remains only in the narrowed area 350 of the handle 347 and will not slide back and forth across the full length of the handle 347. The string tether 319 thus attached to the narrowed area 350 of the handle 347 secures the floatation apparatus 310 to a pouch 351 as shown in FIGS. 12 and 13 at the other end of the string tether 319 to prevent the floatation apparatus 310 from drifting away from the user.

A second difference between the handles 347 and 348 is shown in FIG. 7. The handle 347 on the non-apertured end wall member 312 is not U-shaped or fully arched like the handle 348 on the apertured end wall member 313. It is preferred that the handle 347 on the non-apertured end wall 312 have a concave area 352 between its bulbous and its narrowed ends 349, 350 so as to minimize the length of the floatation apparatus 310 when in its compressed state for compact carrying on a user's person when not in use. In contrast, the handle 348 on the apertured end wall member 313 has no concavity, but is preferably fully arched in order to prevent interference of the handle 348 with the removal of a cap 339 from spout 326 surrounding an aperture 325 in the apertured end wall member 313.

The spout 326 which surrounds the aperture 325 projects transversely outwardly from the outer surface of the apertured end wall member 313 in order for the cap 339 to be snapped into place over the aperture 325 for tight fitting contact with a snapper member 353 on the spout 326. When the cap 339 is unsnapped from its tight fitting contact with the snapper member 353 of the spout 326, the aperture 325 is open and air may enter or exit the air chamber 315 in order to expand or compress the floatation apparatus 310. When the cap 339 is snapped into tight fitting contact with the snapper member 353 of the spout 326, the aperture 325 is closed against the entry or exit of air from the air chamber 315 in order to keep the floatation apparatus 310 in either its expanded or compressed state.

Figure 8:
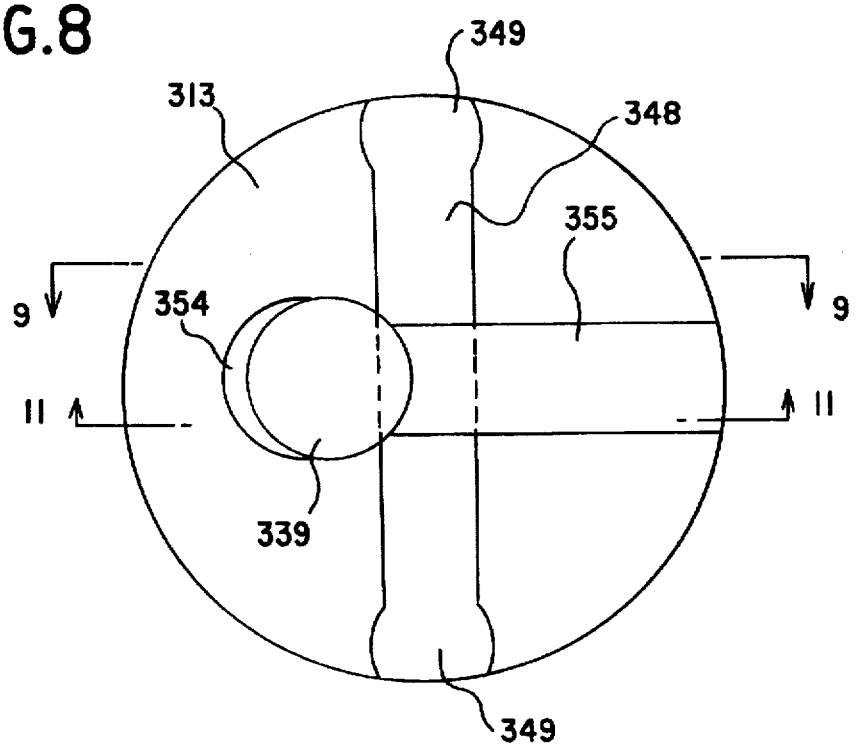
FIG. 8 is an end view of the third embodiment of the compressible and expandable floatation apparatus showing the handle on the apertured end wall.
Figure 9:
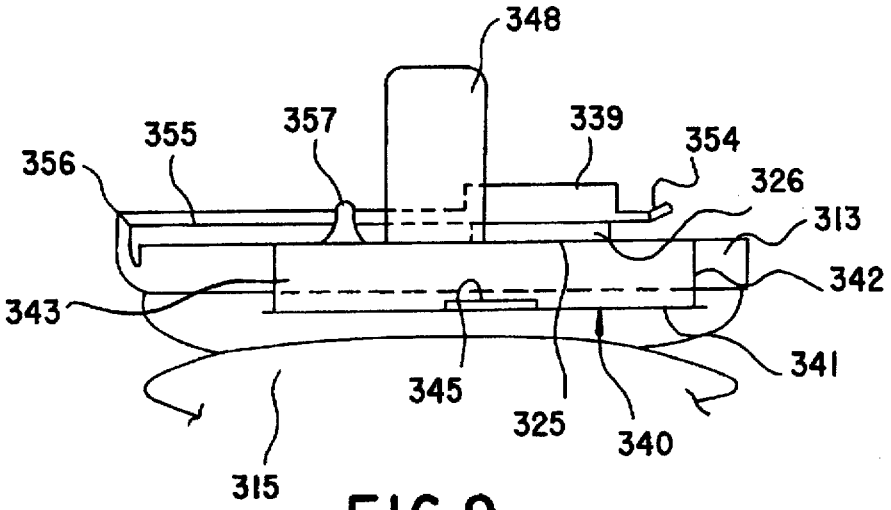
FIG. 9 is a view taken along line 9—9 of FIG. 8 showing details of the cap and backdraft valve assemblies.

Referring to FIGS. 8 and 9, the cap 339 has a cap lip 354 and cap tether 355. The cap lip 354 extends transversely outwardly from the side wall of the cap 339 to provide access for a user's thumb to unsnap the cap 339 from the spout 326. The cap tether 355 is preferably an extruded rectangular plastic piece having two ends. One end of the cap tether 355 is attached to the cap 339 and the other end of the cap tether 355 is attached to the side of apertured end wall member 313.

A hinge bend 356 is located near the end of the cap tether 355 that attaches to the side of the apertured end wall member 313. The hinge bend 356 allows the main body portion of the cap tether 355 to rest slightly above and parallel to the outer surface 322 of the apertured end wall member 313 when the cap 339 is snapped into tight fitting contact with the snapper member 353 of the spout 326 over the aperture 325. When the cap 339 is unsnapped, the main body portion of the cap tether 355 rests at an angle to the outer surface 322 of the apertured end wall member 313. In this way, the cap tether 355 acts to keep the removable cap 339 near the apertured end wall member 313 for quickly locating the cap 339 in order to snap the cap 339 onto the spout 326 to close the aperture 325.

The cap tether 355 may be kept from being displaced very far from the apertured end wall member 313 by the use of cap tether guides 357. The cap tether guides 357 are connected to and project transversely outwardly from the outer surface 322 of the apertured end wall member 313. The cap tether guides 357 fit against and slightly overtop of cap tether 355 to limit the angle the cap tether 355 may rotate through and to provide the cap 339 with spring action up and down over the aperture 325. The cap tether 355 and the cap tether guides 357 also function together to keep the cap 339 aligned over the spout 326 so that the cap 339 can be readily snapped into place over the aperture 325 in an emergency situation.

Figure 11:
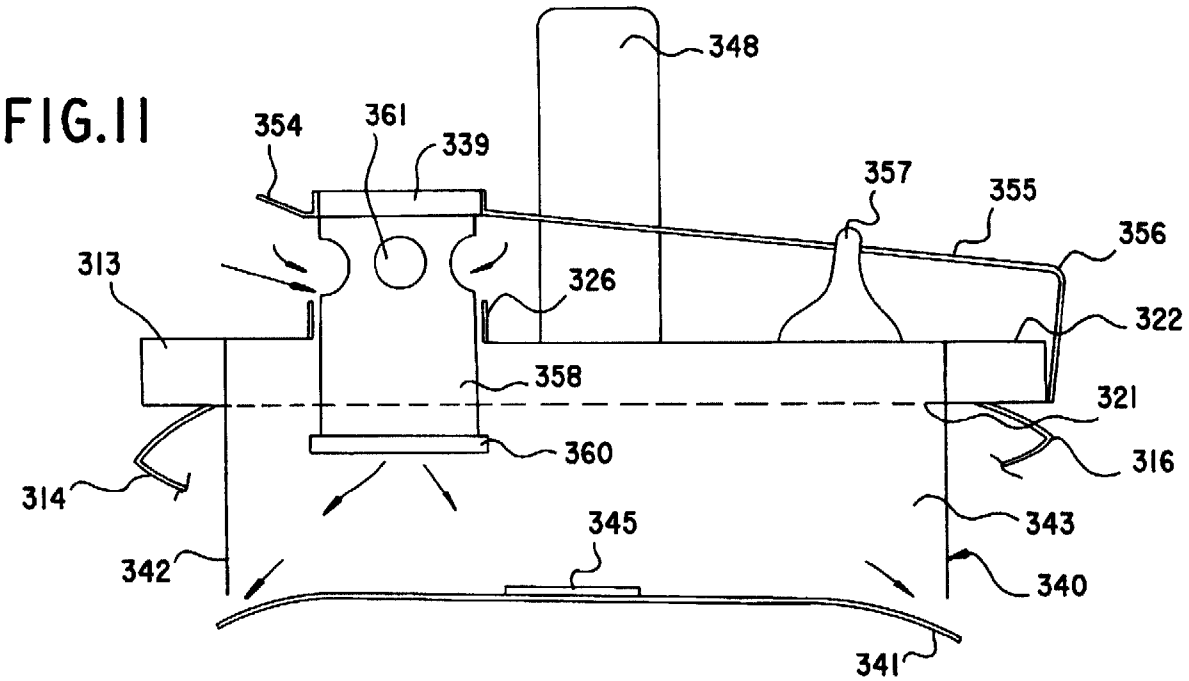
FIG. 11 is a view taken along line 11—11 of FIG. 8 showing the cap in its opened position.

Referring to FIG. 11, the removable cap 339 may have an additional safety feature for alignment of the cap 339 over the aperture 325 in the form of a cylindrical attachment 358. When used in conjunction with the cap 339, cap tether 355 and cap tether guides 357, the cylindrical attachment 358 is attached to the bottom surface of the cap 339, preferably by heat-sealing. The cylindrical attachment 358 includes a hollow main body portion 359 and a molded bottom stop 360. The hollow main body portion 359 includes up to nine air holes 361. The air holes 361 allow air to enter and exit the air chamber 315 of the floatation apparatus 310 when the cap 339 is unsnapped from its tight fitting contact with the snapper member 353 of the spout 326.

The cylindrical attachment 358 extends downwardly from the bottom surface of cap 339 through the spout 326 and into the aperture 325. In this way, the cap 339 may be removed from its tight fitting contact with the snapper member 353 of the spout 326, but displaced only a small distance from the spout 326 and aperture 325 since the molded bottom stop 360 prevents the cylindrical attachment 358 from being completely removed from the aperture 325.

The cylindrical attachment 358 thus acts as a splash guard to protect against water entering the air chamber 315 when the floatation apparatus 310 is being expanded in proximity to the water or when the user is in the water and holding the floatation apparatus 310 above the water for expansion. At the same time, the air holes 361 in the side wall of the hollow main body portion 359 of the cylindrical attachment 358 allow air to enter into the air chamber 315 of the floatation apparatus 310 via the aperture 325.

Figure 10:
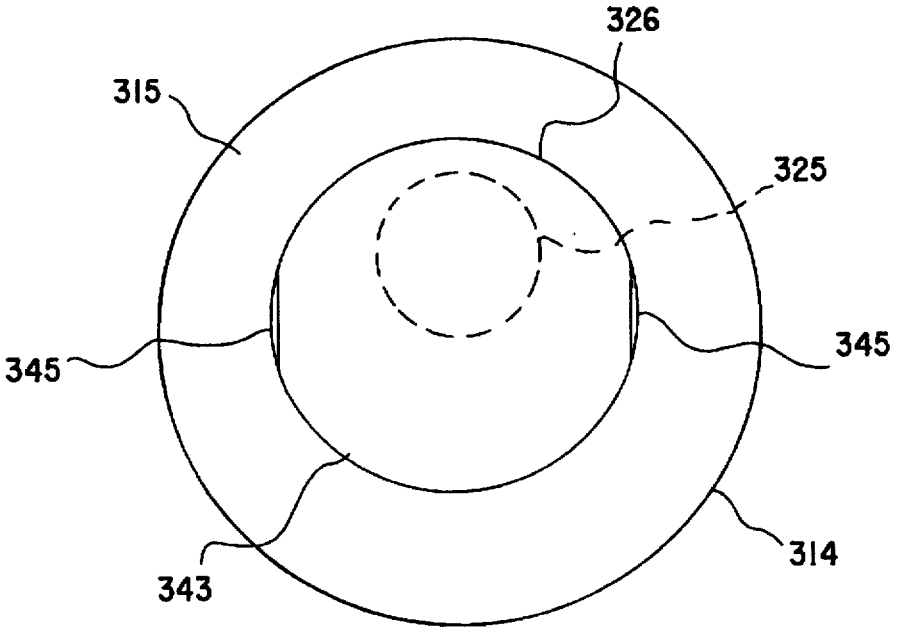
FIG. 10 is a view taken along line 10—10 of FIG. 4.

Referring to FIGS. 9, 10 and 11, a backdraft valve 340 is shown which may be incorporated into the floatation apparatus 310 as a safety feature. The backdraft valve 340 functions as a precaution against the rapid deflation of the floatation apparatus 310.

Referring to FIGS. 12 and 13, the floatation apparatus 10 (210 and 310) may be carried in its compressed state on the user's person in a pouch 51 (251 and 351). A string tether 19 (219 and 319) may be used to secure the floatation apparatus 10 (210 and 310) to its carrying pouch 51 (251 and 351) to prevent it from drifting away from the user.

The carrying pouch 51 (251 and 351) may be either a zippered fanny pack such as is shown in FIG. 12 or a velcroed vertical waist pouch such as is shown in FIG. 13. Both types of pouches 51 (251 and 351) have drainage holes 62 (262 and 362) located at the bottom of the pouch 51 (251 and 351) to allow for drainage of water when the compressed floatation apparatus 10 (210 and 310) is returned to the pouch 51 (251 and 351) after use. Further, both types of pouches 51 (251 and 351) are worn around the user's waist via adjustable belt straps 363 (263 and 363) and matingly connectable male and female belt buckle closures 64 (264 and 364), 65 (265 and 365) which are attached to the ends of belt straps 63 (263 and 363).

The fanny pack may have the added safety feature of a float attachment 66 (266 and 366) attached to its zipper 67 (267 and 367) on the zipper tab 68 (268 and 368). The float attachment 66 (266 or 366) provides for ready location of the zipper tab 68 (268 and 368) in order to unzip the pouch 51 (251 or 351) for quick access to the initially compressed floatation apparatus 10 (210 or 310) for expansion in an emergency situation.

Figure 14:
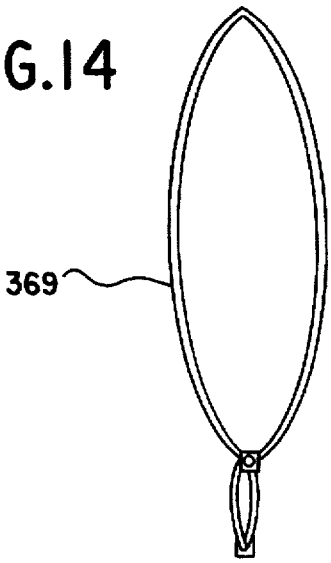
FIG. 14 is a front view of a shoulder sling for use in carrying the compressible and expandable floatation apparatus in either its compressed or expanded state.

Alternatively, the floatation apparatus 10 (210 or 310) may be carried by means of a sling 69 (269 or 369) as illustrated in FIG. 14. The sling 69 (269 or 369) is worn over the user's head and shoulders to carry the floatation apparatus 10 (210 or 310) in either its compressed or expanded state.

The use of a pouch 51 (251 or 351) or a sling 69 (269 or 369) to carry the floatation apparatus 10 (210 or 310) on the user person does not interfere with the user's other activities, yet provides easy access to the floatation apparatus 10 (210 or 310) for quick expansion in an emergency situation.

Referring to FIG. 15, a fourth embodiment of the compressible and expandable floatation apparatus 410 is shown. The fourth embodiment of the invention is similar to the second embodiment of the present invention in that it includes a cylindrical side wall 414 extending between non-apertured and apertured end wall members 412, 413 which is not bellows-shaped as in the preferred embodiment, but that is made by enclosing coiled wire 446 within plastic sheet material 470 to form a length of hose or tubing resembling the type of duct typically used to vent a clothes dryer.

The plastic sheet material 470 for use in forming the cylindrical side wall 414 of the fourth embodiment of the floatation apparatus 410 is preferably polyvinyl because of its puncture-resistance and compressibility. However, any suitable material which is capable of forming walls that are somewhat puncture resistant and compressible may be used.

The coiled wire 446 is enclosed within the inner and outer surfaces of the cylindrical side wall 414 to act as a skeleton to support the side wall 414 in its essentially cylindrical shape. The coiled wire 446 enclosed within the cylindrical side wall 414 also functions to allow the cylindrical side wall 414 to fold and unfold in an accordion-like manner. The folding and unfolding of the cylindrical side wall 414, in turn, allows the air chamber 415 of the floatation apparatus 410 to expand or compress.

The cylindrical side wall 414 of the fourth embodiment of the invention is preferably approximately three inches in diameter. When constructing a floatation apparatus 410 having a three inch diameter cylindrical side wall 414, it is preferred that the fully expanded floatation apparatus 410 measure approximately five to six feet long end to end in order to have an approximately one and one-half gallon capacity.

The non-apertured and apertured end wall members 412, 413 of the fourth embodiment of the present invention are molded in a manner similar to that described for the preferred embodiment. The fourth embodiment of the present invention, like the preferred and second embodiments, includes a touch-button type cap 439. Unlike the end wall members of the preferred and second embodiment, however, the end wall members 412, 413 of the fourth embodiment are additionally formed to have integrally attached belt straps 463 molded to the outer surface 422 of the end plate 420 of the aperture end wall 413.

Attached to the end of each of the belt straps 463 are belt buckle closures 464, 465. Belt buckle closure 464 is a male belt buckle closure and belt buckle closure 465 is a female belt buckle closure. The female belt buckle closure 465 slidingly mates with the male belt buckle closure 464 in order for the floatation apparatus 410 to form a ring which may be worn under the arms of a user.

Figure 16:
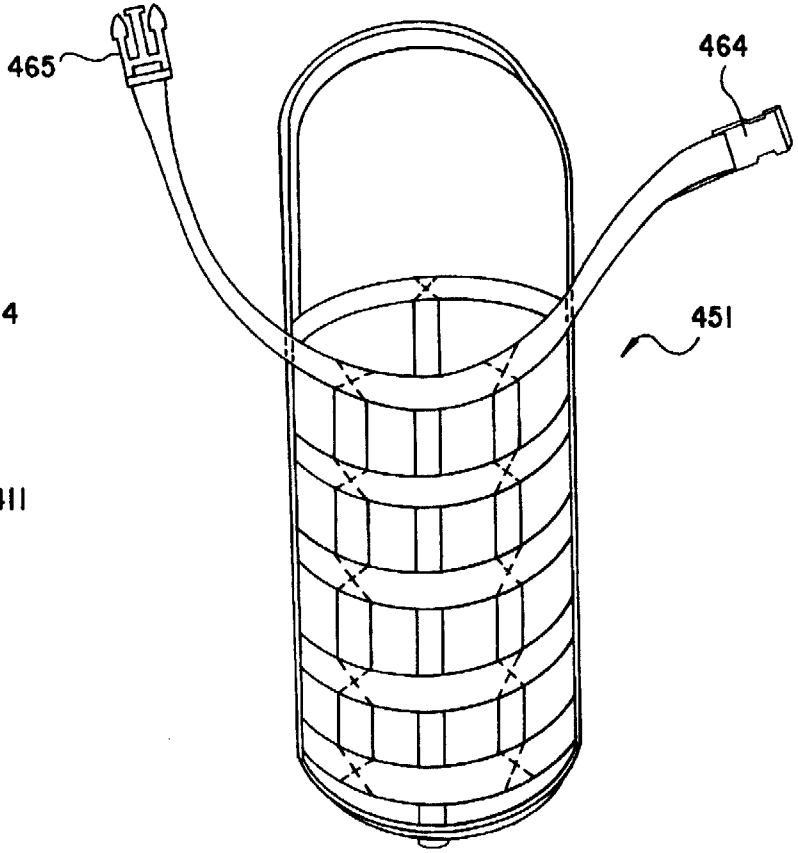
FIG. 16 is a front view of a carrying harness for use in transporting the fourth embodiment of the compressible and expandable floatation apparatus in its compressed state.

Referring to FIG. 16, a special carrying harness 451 is shown in which the floatation apparatus 410 may be carried. The carrying harness 451 is made of numerous nylon straps shown sewed together in the configuration shown in FIG. 16 in order to carry the longer, smaller diameter floatation apparatus 410 of the fourth embodiment.

Figure 17:
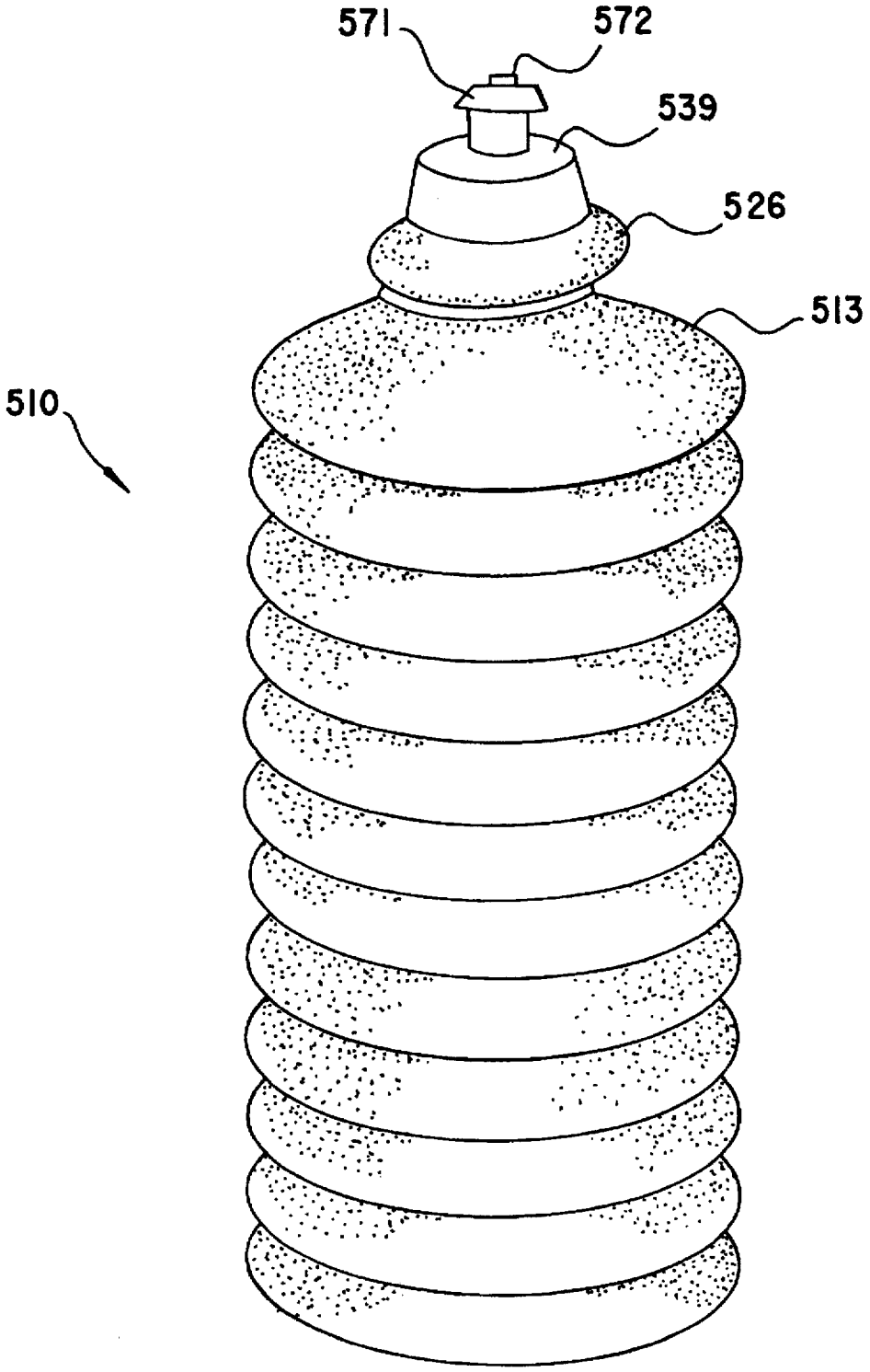
FIG. 17 is a front view of a fifth embodiment of the compressible and expandable floatation apparatus for use as a marker.

Referring to FIG. 17, a fifth embodiment of the compressible and expandable floatation apparatus 510 is shown. The fifth embodiment of the present invention is similar to the preferred embodiment in that it includes a cylindrical side wall 514 extending between non-apertured and apertured end wall members 512, 513 which is bellows-shaped. However, the fifth embodiment of the present invention differs from all the other embodiments in having integrally molded end wall members 512, 513 and a push-pull type cap 539.

Figure 18A:
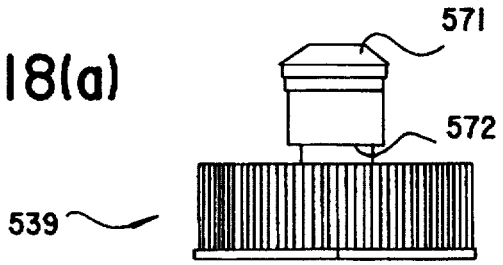
FIG. 18(*a*) is a front view of the push-pull type cap used in the fifth embodiment of the invention showing the detail of the cap.
Figure 18B:
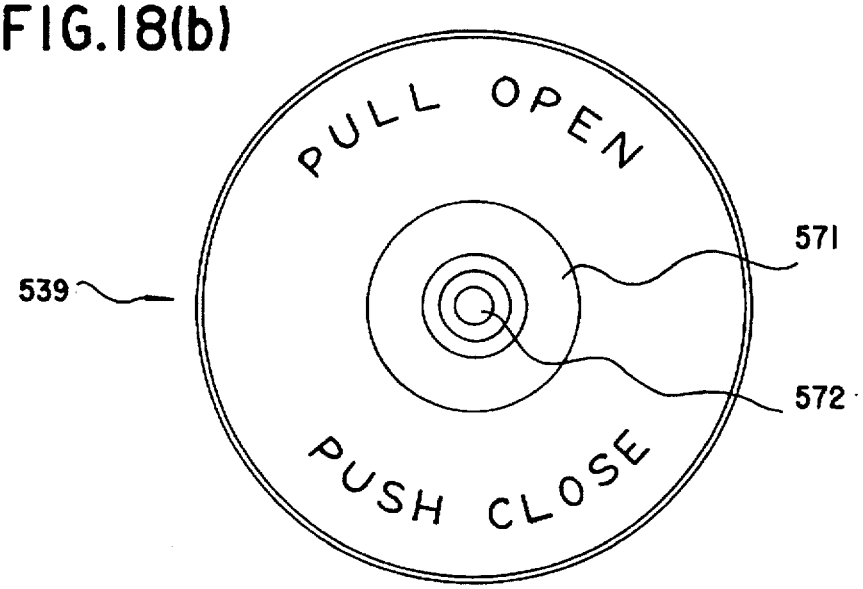
Figure 18C:
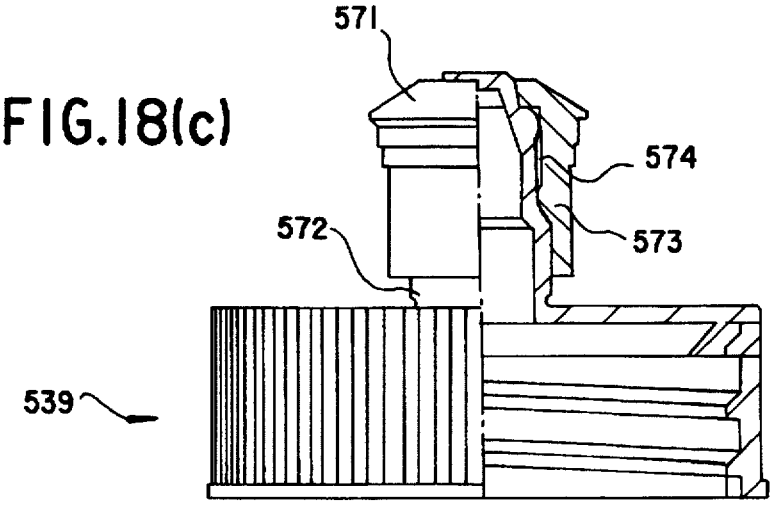

Referring to FIGS. 18(*a*) through 18(*c*), the push-pull type cap 539 of the fifth embodiment is shown. The push-pull type cap 539 has a plunger member 571 which is moveable up and down on a spout member 572 by means of a protrusion 573 on the inside of the plunger member 571 which is slidable within a groove 574 on the outside of the spout member 572. When the plunger member 571 is in its pulled up position, air is free to enter into the air chamber 515 via the aperture 525 of the floatation apparatus 510. When the plunger member 571 is in its pushed down position, the aperture 525 is closed off to the entry of air into the air chamber 515 of the floatation apparatus 510.

The fifth embodiment of the present invention also differs from the other embodiments in that the fifth embodiment is no intended for use as a personal floatation apparatus but rather as a marker float for marking swimming or snorkeling areas, marking areas searched or dragged by rescue personnel, or marking fishing nets or crab traps. Thus, this embodiment does not include the safety feature of a back-draft valve as do the other embodiments because such is not necessary for the particular applications of the fifth embodiment.

Figure 19A:
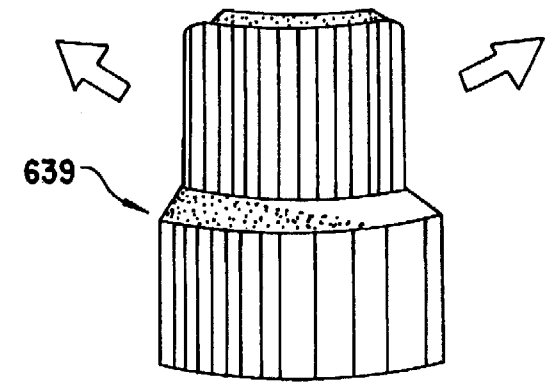
FIG. 19(*a*) is a front view of a twist cap which is a first alternate embodiment of the cap shown in FIGS. 2(*a*) and 2(*b*).
Figure 19B:
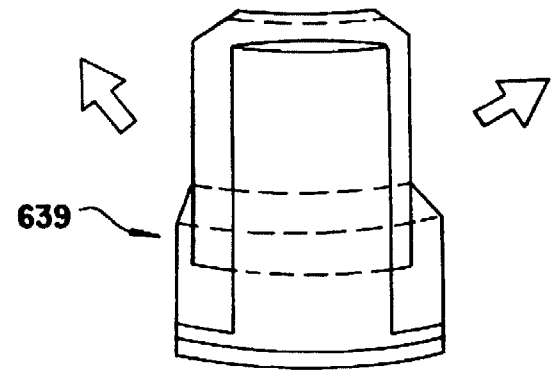

Finally, referring to FIGS. 19(*a*) and 19(*b*), 20(*a*) and 20(*b*), and 21(*a*) and 21(*b*), other embodiments of caps usable in with anyone of the embodiments thus far described are shown. FIGS. 19(*a*) and 19(*b*) show a twist top type cap 639. This type of cap is advantageous in allowing less air and water leakage than the preferred touch button type cap 39 (239 and 439) but is less desirable for use in emergency situations. This is because the twist top cap 639 requires two motions, i.e., both grasping and turning to open and close the cap 639, whereas a touch button type cap 39 (239 and 439) requires only one motion, i.e., only pressing on the rocker member 27 (227 and 427), to open and close the cap 39 (239 and 439).

Figure 20A:
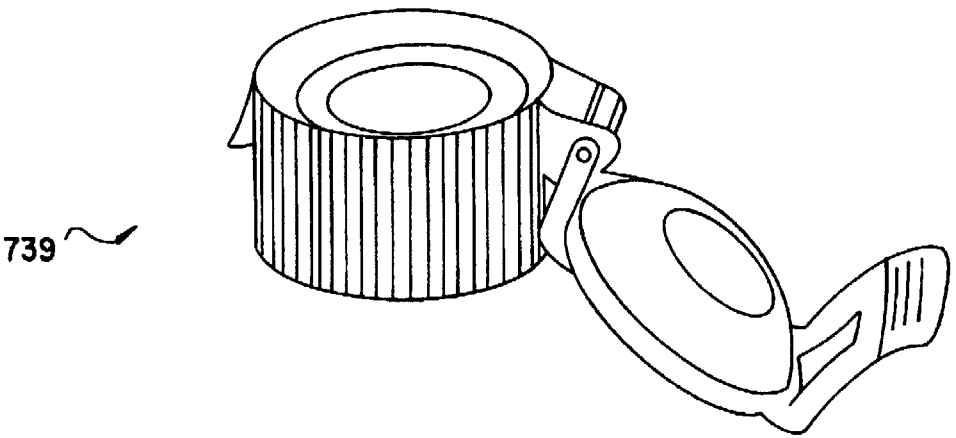
FIG. 20(*a*) is a front view of an open flip-top cap which forms a second alternate embodiment of the cap shown in FIGS. 2(*a*) and 2(*b*).
Figure 20B:
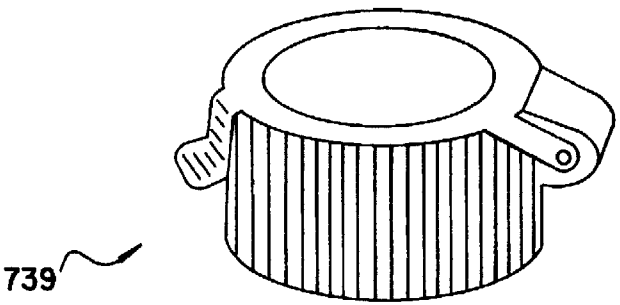

FIGS. 20(*a*) and 20(*b*) show a flip top type cap 739 shown in both its open and closed position, respectively. Like the twist top type cap 639, the flip top cap 739 has the advantage of allowing less air and water leakage than the touch button type cap 39 (239 and 439), but is disadvantageous in needing more time to open and close which is undesirable in emergency situations.

Figure 21A:
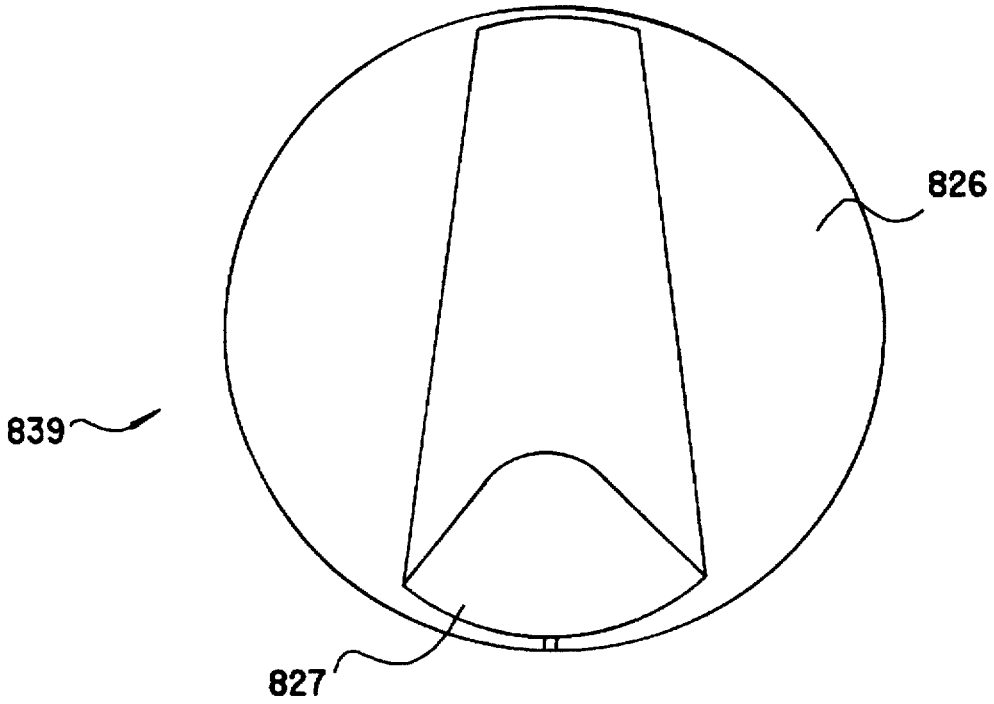
FIG. 21(*a*) is a top plan view of a second embodiment of the touch-button type cap as is shown in FIGS. 2(*a*) and 2(*b*).
Figure 21B:
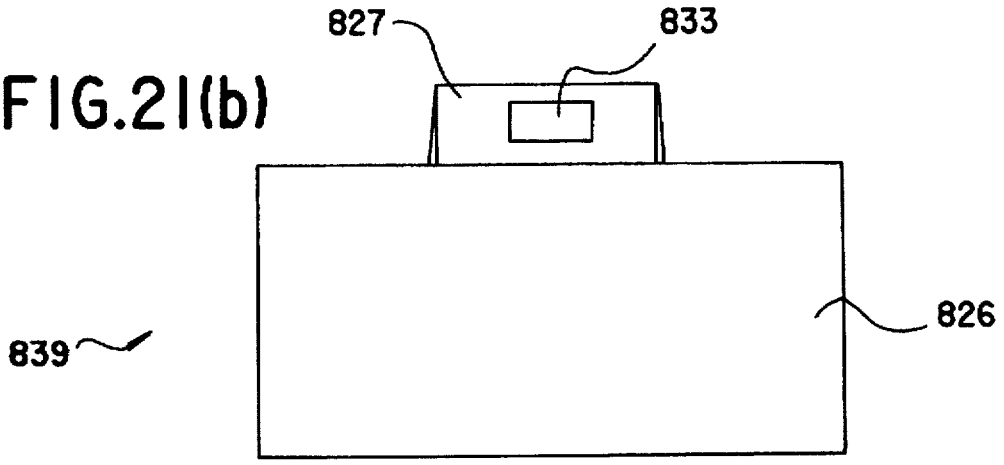

FIGS. 21(*a*) and 21(*b*) show a partial touch button type cap 839 which is a modified version of the touch button type cap 39 (239 and 439) shown in the preferred, second and fourth embodiments of the present invention. It should be noted that any of the types of caps mentioned above, and others well known in the prior art but not mentioned, may be used in any of the embodiments of the invention without departing from the spirit and scope of the invention. In addition, the use of an o-ring seal, especially with the touch button and flip top caps is contemplated to reduce the leakage of air through the cap in order to keep the floatation apparatus in its expanded or compressed state.

In operation, the different embodiments of the floatation apparatus of the present invention work generally as follows. A user of the floatation apparatus 10 (210, 310, 410 and 510) removes the floatation apparatus 10 (210, 310, 410 and 510) from where it is being stored or carried. If the floatation apparatus 10 (210, 310, 410 and 510) is being carried in its compressed state on the user's person while the user is swimming or near the shore either by means of a pouch 51 (251 and 351) to which it is attached by means of string tether 19 (219 or 319) or a sling 69 (269 and 369), the floatation apparatus 10 (210, 310, 410 and 510) must first be removed from its carrying pouch 51 (251 and 351), harness 451 or sling 69 (269 and 369). It should be noted that a floatation apparatus 10 (210, 310 and 410) carried in its compressed state on a user's person will not interfere with the user's swimming since it provides little, if any, water drag to slow the swimmer down.

When the user desires to expand the initially compressed floatation apparatus 10 (210, 310, 410 and 510), the user must hold the floatation apparatus 10 (210, 310, 410 and 510) above the water's surface. Therefore, if the user is in the water, the user must remove the floatation apparatus 10 (210, 310, 410 and 510) from its initially compressed and carried position and hold the floatation apparatus 10 (210, 310, 410 and 510) above the water's surface.

The user opens the cap 39 (239, 339, 439 and 539) by the appropriate method according to the type of cap 39 (439, 539, 639, 739 and 839). The user then either allows the floatation apparatus 10 (210) to automatically self-expand if of the type having self-expanding cylindrical side walls 14 (214) or pulls the floatation apparatus (310, 410 and 510) apart to unfold the cylindrical side walls (314, 414 and 514) and to expand the floatation apparatus (310, 410 and 510). The motion of the self-expanding cylindrical side walls 14 (214) or the pulling of the floatation apparatus (310, 410 and 510) apart draws air through the aperture 25 (225, 325, 425 and 525). As air is drawn through the uncapped aperture 25 (225, 325, 425 and 525), it pushes on the flap 41 (241, 341 and 441) of the backdraft valve 40 (240, 340 and 440) and enters into the air chamber 15 (215, 315 and 415).

The user then repositions the cap 39 (239, 339, 439 and 539) back into its tight fitting relationship with the spout 26 (226, 326, 426 and 526) surrounding the open aperture 25 (225, 325, 425 and 525) to close the aperture 25 (225, 325, 425 and 525). In this way, a volume of air is trapped within the air chamber 15 (215, 315, 415 and 515) so that the user may use the floatation apparatus 10 (210, 310 and 410) by holding it close to his chest in order to remain afloat in the water or to use the floatation apparatus 510 as a marker.

When swimming with the floatation apparatus 10 (210, 310 and 410) in its expanded state, the one-gallon capacity of the air chamber 15 (215, 315 and 415) of the floatation apparatus 10 (210, 310 and 410) provides an adult with approximately thirty-five pounds of buoyancy.

After use, the user may easily compress the floatation apparatus 10 (210, 310, 410 and 510) by holding it above the water and opening the cap 39 (239, 339, 439 and 539) by the means necessary for the type of cap on the particular embodiment of the float to be compressed. The user must then apply pressure to the floatation apparatus 10 (210, 310, 410 and 510) in order for air to escape slowly from the tubular chamber 15 (215, 315 and 415) via the backdraft valve 40 (240, 340 and 440) and aperture 25 (225, 325, 425 and 525). As the floatation apparatus 10 (210, 310, 410 and 510) slowly compresses, the cylindrical side wall 14 (214, 314, 414 and 514) folds in its accordion-like manner. The compressed floatation apparatus 10 (210, 310, 410 and 510) may then be returned to storage whether it be a compartment on a boat or airplane etc., a pouch 51 (251, 351) or carrying harness 451 to which it is tethered via string tether 19 (219 and 319) or to the sling 69 (269 and 369) for carrying.

Although the invention has been described in detail for the purpose of illustration, it is to be understood that such detail is solely for that purpose and that variations can be made therein by those skilled in the art without departing from the spirit and scope of the invention except as the invention may be limited by the claims as follow.

I claim:

1. A compressible and expandable floatation apparatus which is quickly expandable without aid of a pump, breathing tube or gas cartridge for inflation, said flotation apparatus comprising:

means for enclosing a variable volume of air within a tubular main body portion which includes a cylindrical side wall extending between first and second end wall members to enclose an air chamber;

one of said first or second end wall members including an aperture therethrough;

cap means for opening and closing said aperture to the passage of air into and out of said air chamber, wherein said cap means comprises a friction fit type cap including means for safety and alignment which includes a cylindrical attachment having a molded bottom stop and a hollow main body portion with air holes therein, said cylindrical attachment being attached to a bottom surface of said cap means for displacement up and down in said aperture as said cap means is snapped and unsnapped from tight friction fitting contact with a spout surrounding said aperture, wherein said cylindrical attachment is prevented from being totally removed from said aperture by said bottom stop in order to act as a splash guard to keep water from entering said tubular chamber when said floatation apparatus is expanded in proximity to a body of water, but to also allow air to enter said tubular chamber of said floatation apparatus through said air holes of said cylindrical attachment when said cap is removed from said tight friction fitting contact with said spout;

said cylindrical side wall being foldable into a compressed state, thereby forcing air out of said air chamber through said aperture in one of said first and second end walls, to decrease said volume of said air chamber or being unfoldable into an expanded state, thereby forcing air into said air chamber through said aperture in one of said first and second end walls, to increase said volume of said air chamber, wherein said side wall is made up of a plurality of substantially circular bellows having conical sections connected at a predetermined angle for said cylindrical side wall to fold and unfold in an accordion-like manner;

said aperture being capped when said apparatus is in said compressed state or in said expanded state in order to maintain said apparatus in said compressed state or in said expanded state, respectively;

said aperture being uncapped when said apparatus is to be expanded from said compressed state or compressed from said expanded state;

means for dually functioning to slow down a normal rate at which air exits said air chamber when said floatation apparatus is being compressed and for allowing air to enter said air chamber at said normal rate when said floatation apparatus is being expanded.

2. The floatation apparatus as in claim 1, wherein said means for slowing down air exiting said air chamber comprises a backdraft valve having a cylindrical wall extending into said air chamber from an inner surface of said apertured wall member to surround a cylindrical back draft chamber which has an open end covered by a circular flap of thin plastic material, said flap being attached to a rim of said cylindrical wall in two positions around a periphery of said rim in order for said backdraft chamber to be directly adjacent to said aperture so that a periphery of said flap is deflected downward when air is entering said backdraft chamber but is pressed against said rim of said backdraft chamber side wall when air is exiting said air chamber.

3. The floatation apparatus as in claim 2, wherein said first and second end wall members each comprise a circular disk shaped end wall plate having inner and outer surfaces, a cylindrical end wall extension and a shoulder connecting said end wall plate approximately perpendicularly to said end wall extension in order for said end wall extensions to be attached to each side of said cylindrical side wall.

4. The floatation apparatus as in claim 3, wherein said apertured end wall member is surrounded by said spout which extends transversely outwardly from said outer surface of said end wall plate in order to be capable of receiving said cap means to close or open said aperture from air entering into and exiting out of said air chamber, respectively.

5. The floatation apparatus as in claim 4, wherein said cylindrical side wall and said tubular chamber are approximately 4 to 4.5 inches in diameter and said floatation apparatus, when in said fully compressed state is approximately 5 to 6 inches long, and when in said fully expanded state is approximately 20 inches long with an approximately one gallon capacity.

6. The floatation apparatus as in claim 1, wherein said first and second end walls include handle means for grasping by a user of said floatation apparatus in order for a user of said floatation apparatus to move said first and second end walls away from each other to expand said floatation apparatus or towards each other to deflate said floatation apparatus.

* * * * *